US005258688A

United States Patent [19]

Fondrk

[11] Patent Number: 5,258,688

[45] Date of Patent: Nov. 2, 1993

[54] CRI FUNNEL WITH CONCAVE DIAGONALS

[75] Inventor: Mark T. Fondrk, Villa Park, Ill.

[73] Assignee: Zenith Electronics Corporation, Glenview, Ill.

[21] Appl. No.: 871,448

[22] Filed: Apr. 21, 1992

[51] Int. Cl.[5] ..... H01J 29/86

[52] U.S. Cl. ..... 313/477 R; 220/2.1 A; 220/2.3 A

[58] Field of Search ..... 313/477 R; 220/2.1 A, 220/2.3 A

[56] References Cited

U.S. PATENT DOCUMENTS 2,764,810 10/1956 Gardiner ..... 220/2.3 A
3,591,035 7/1971 Gossie et al. ..... 220/2.1 A
3,720,345 3/1973 Logue ..... 220/2.1 A

FOREIGN PATENT DOCUMENTS 1487282 9/1977 United Kingdom .

*Primary Examiner*—Sandra L. O'Shea
*Attorney, Agent, or Firm*—Roland W. Norris

[57] ABSTRACT

A CRT funnel, especially useful for CRTs having flat face panels, has concave diagonal walls sections to reduce discontinuity stresses between the face panel and funnel in the evacuated CRT envelope, thereby increasing the CRT pressure strength.

9 Claims, 6 Drawing Sheets

- - - - - - KNOWN FUNNEL
——— PREFERRED FUNNEL

CRI FUNNEL WITH CONCAVE DIAGONALS

BACKGROUND OF THE INVENTION

1. Field of the Invention

The present invention relates generally to cathode ray tube (CRT) funnels. The present invention relates more specifically to CRT funnels in a CRT envelope extending between a generally conical neck section and a generally rectangular, flat, skirtless, face panel.

2. Description of the Related Art

The assignee of the present invention is known to manufacture a flat tension mask (FTM) CRT in a 14 inch diagonal screen size, such as designated by Model No. ZCM 1492. CRT's are evacuated envelopes, which must withstand certain pounds per square inch (p.s.i.) pressure to be considered safe. Because FTM CRTs are constructed with the funnel section attached directly to a face panel which is flat, discontinuity stresses occur at the face panel-to-funnel junction as a result of atmospheric loading on the evacuated tube. As screen sizes and aspect ratios of the screens increase, discontinuity stresses increase for a given wall thickness of panel and funnel and the CRT can withstand less pressure loading. The obvious solution is to increase the mass of the CRT envelope components but numerous drawbacks are associated with this solution.

It is therefore an object of any proper funnel design to decrease these discontinuity stresses, thus enabling the CRT funnel to withstand atmospheric loading at a safe level without undue costs in terms of increased CRT envelope materials and increased processing times.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

FIG. 5A and 5B illustrate known and preferred funnel deformation on a major axis section.

DETAILED DESCRIPTION OF THE PREFERRED EMBODIMENT

Figure 1:
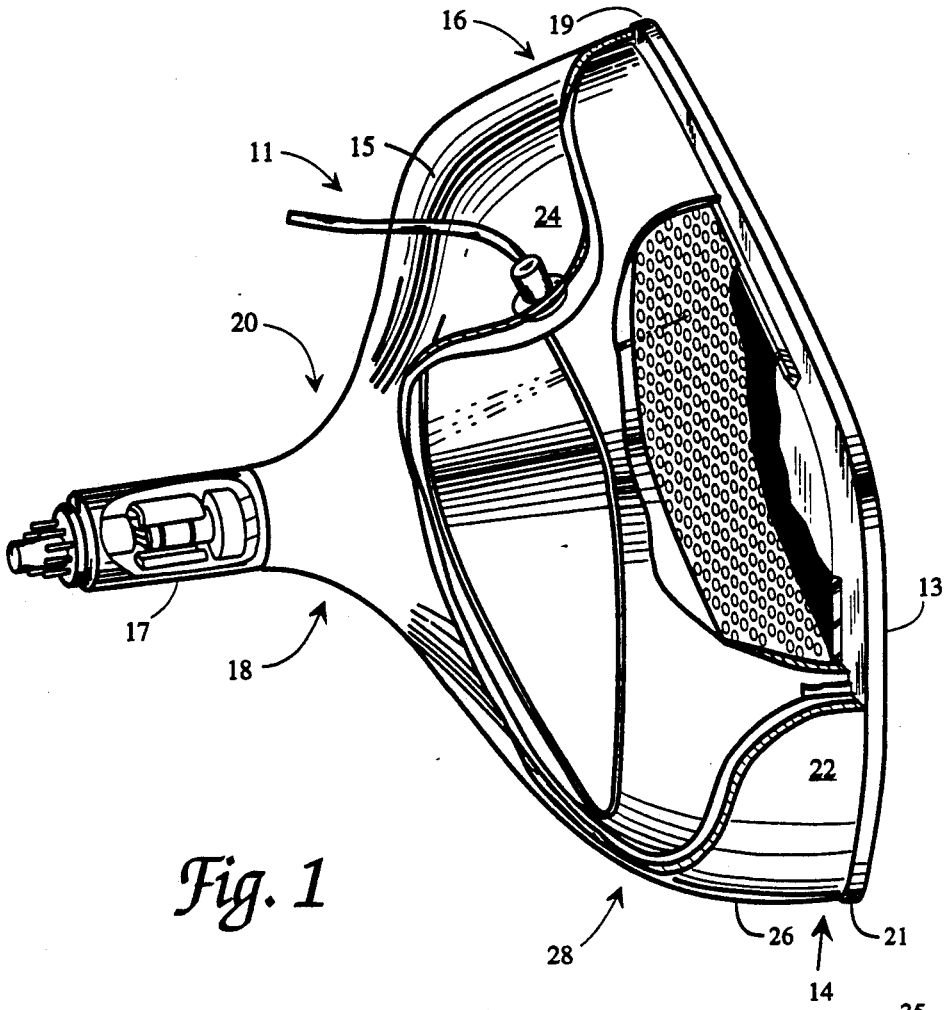
FIG. 1 is a cutaway perspective view of a known FTM CRT illustrating the axes of the tube.

As seen in FIG. 1, an FTM CRT envelope 11 is comprised of a flat, substantially rectangular, face panel 13; a funnel section 15, and a cylindrical neck section 17.

Description of the preferred embodiment of the present invention is with respect to a twenty-two inch diagonal measure screen FTM CRT with ninety degree deflection angle incorporating the novel characteristics as compared to a like-sized funnel design which is generally merely an enlarged version of the known fourteen inch diagonal screen FTM CRT, it being understood that the envelope wall thickness is not proportionally increased, for well known reasons. As seen in both FIGS. 1 and 2, generally CRT funnels 15 have a first end 14 defining a substantially rectangular seal land area 16 ending in a flat seal land 35 for mating with the facepanel 13, and a second end 18 defining a substantially conical area 20 for mating with the cylindrical CRT neck section 17, and over which a deflection yoke (not shown) is fitted. Extending between the rectangular first end 14 and conical second end 18 is a funnel body 28.

FIG. 1 shows a 4:3 aspect ratio FTM CRT 11 illustrating the X, Y and Z axes of the tube. The X axis is designated major. The Y axis is designated minor. A diagonal axis is defined as that line connecting opposite corners, eg. 19, 21, of the substantially rectangular faceplate, or panel 13. The major axis funnel walls 22 are those funnel walls through which the major, or X, axis passes. The minor axis funnel walls 24 are those funnel walls through which the diagonal axes pass and which are transitional between the major and minor axes funnel walls.

Figure 2:
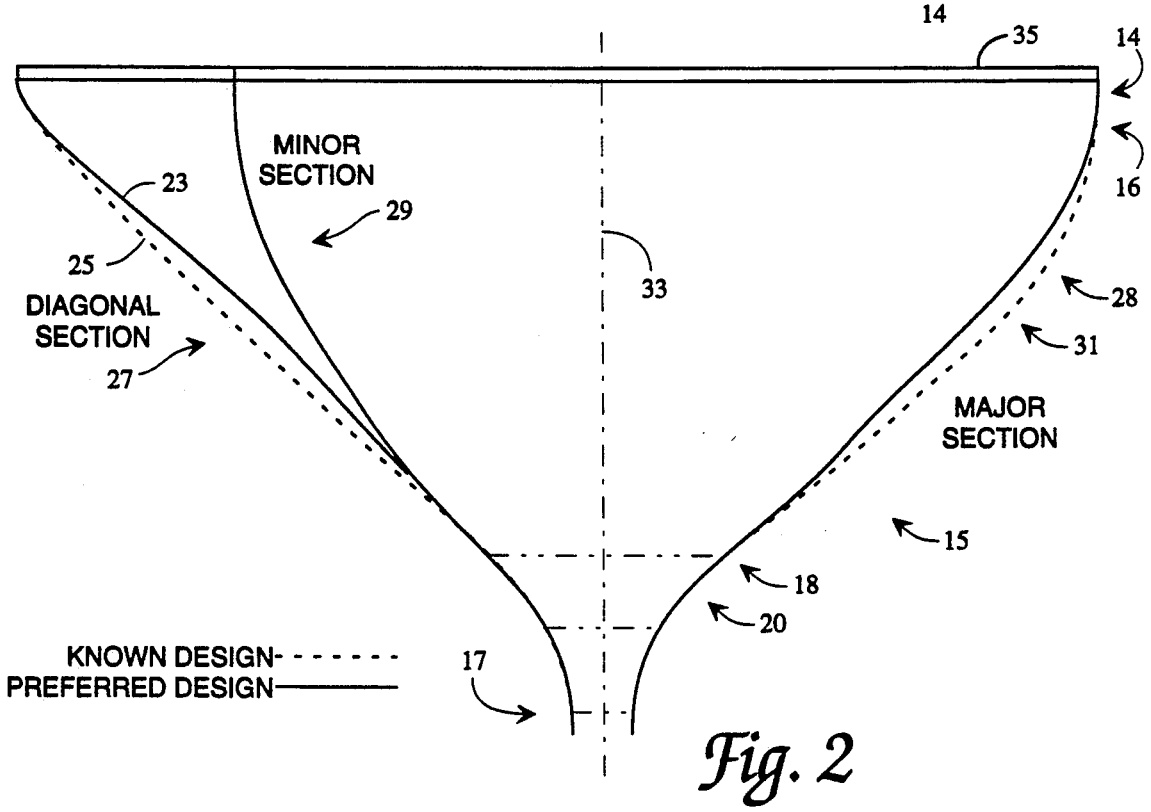
FIG. 2 diagrams sectional views through the tube axes comparing known and preferred funnel designs.
Figure 3A:
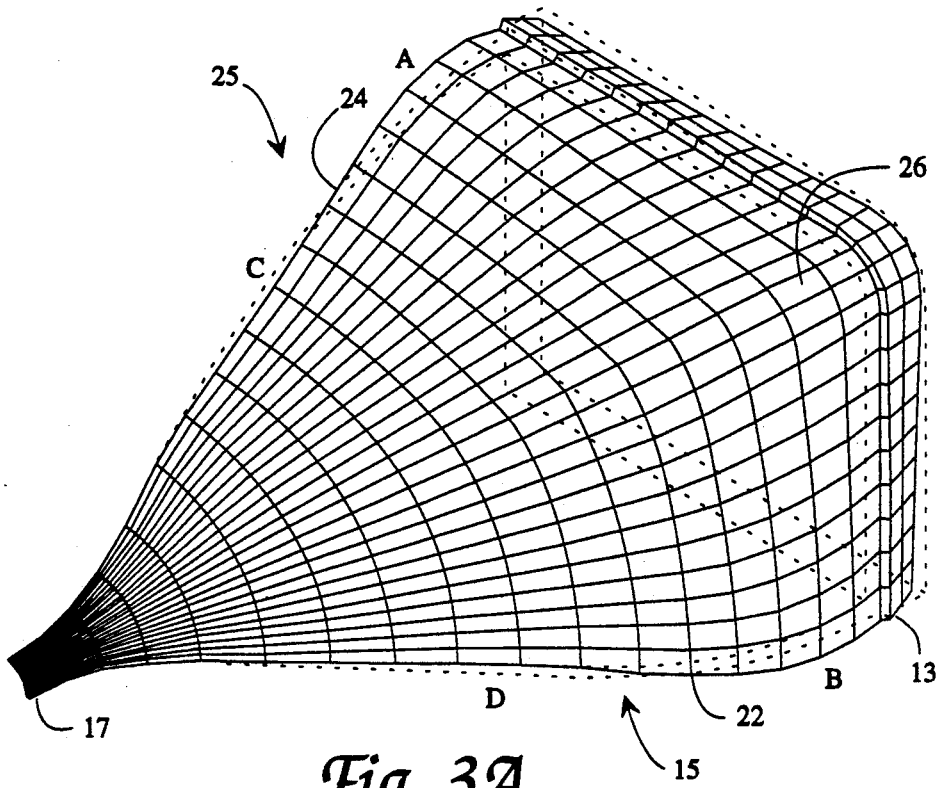
Fig. 3A (PRIOR ART)
FIG. 3A and 3B illustrate known and preferred funnels as deformed upon evacuation, one quarter of the symmetrical tube being illustrated.
Figure 3B:
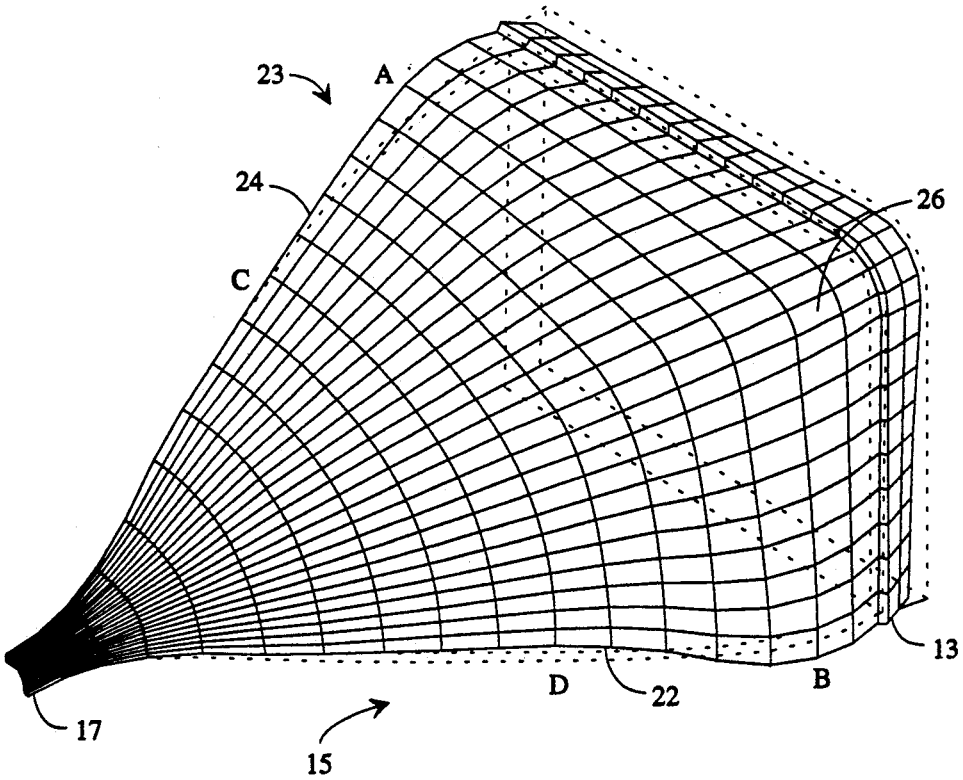
Figure 4A:
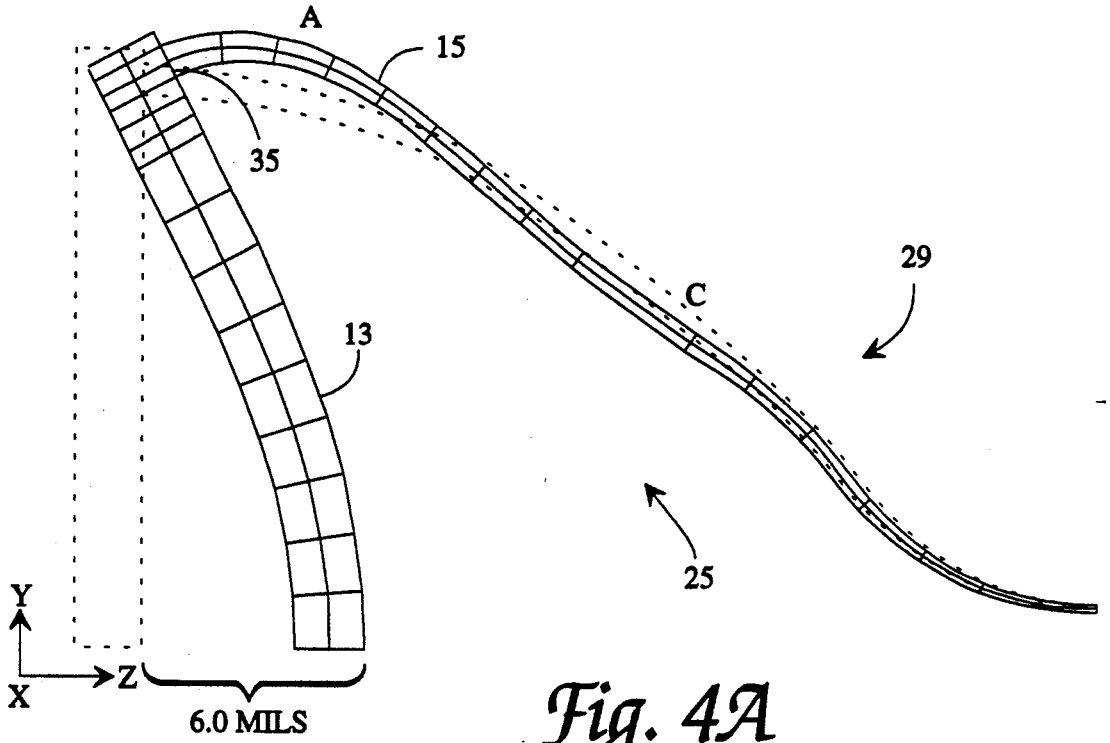
Fig. 4A (PRIOR ART)
FIG. 4A and 4B illustrate known and preferred funnel deformation on a minor axis section.
Figure 4B:
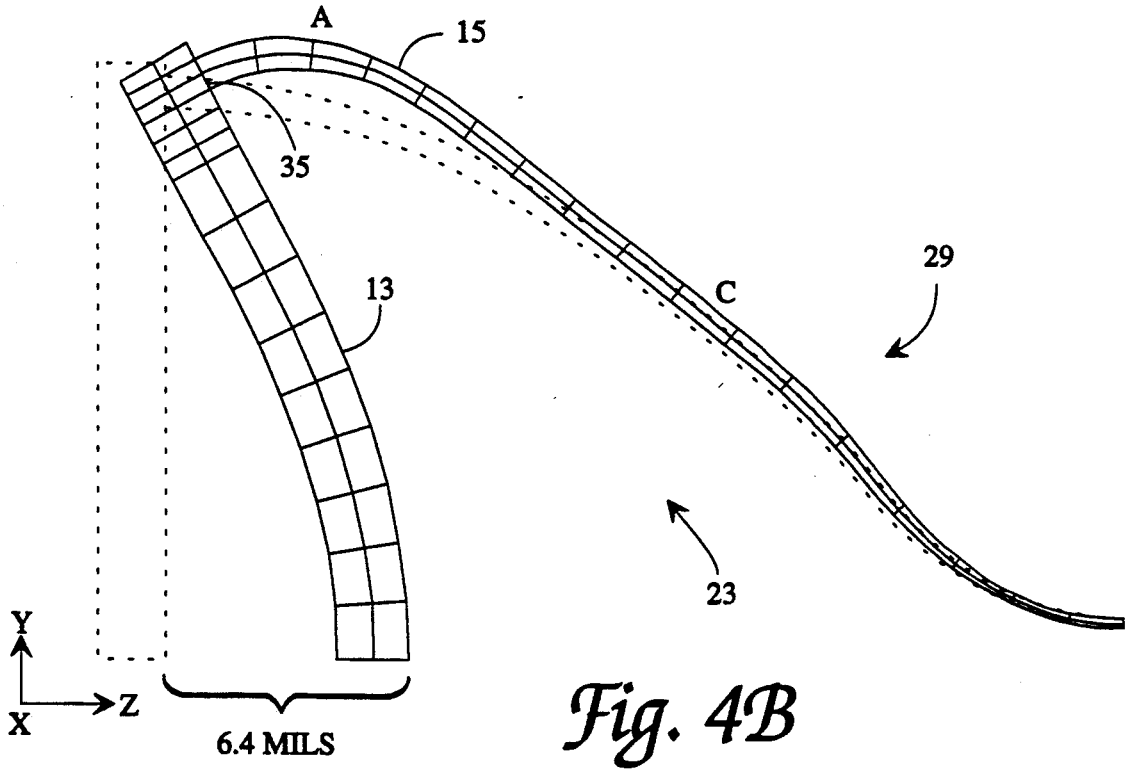
Figure 5A:
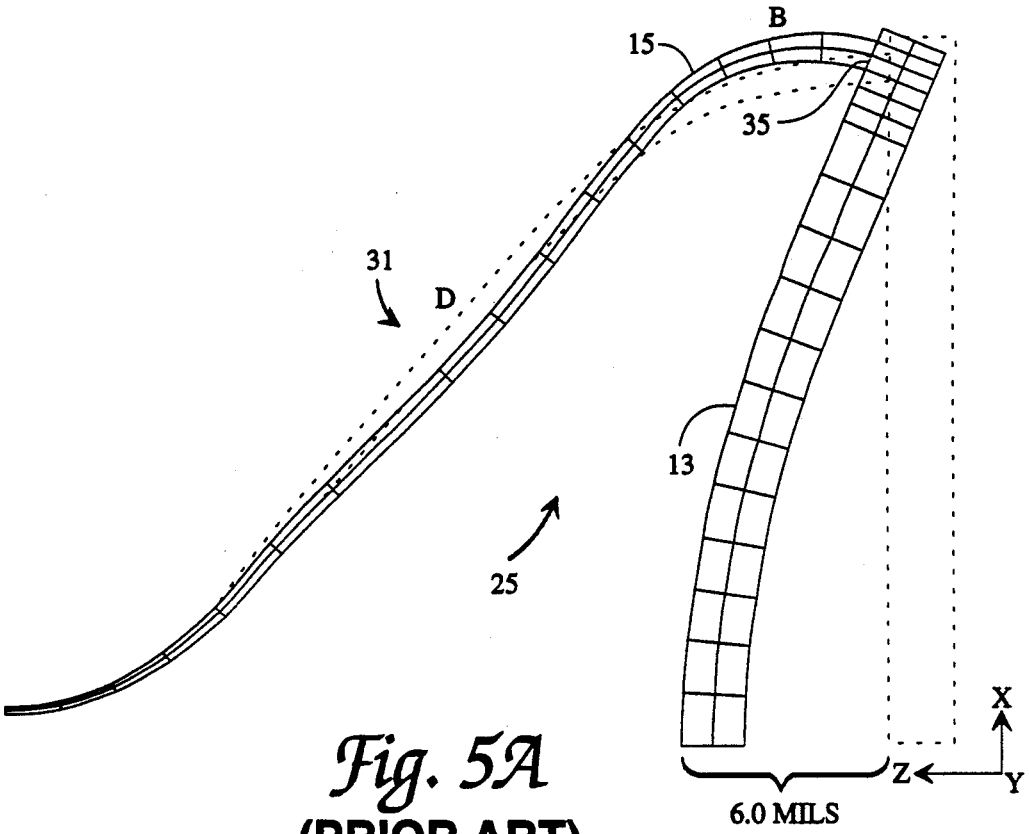
Fig. 5A (PRIOR ART)
Figure 5A:
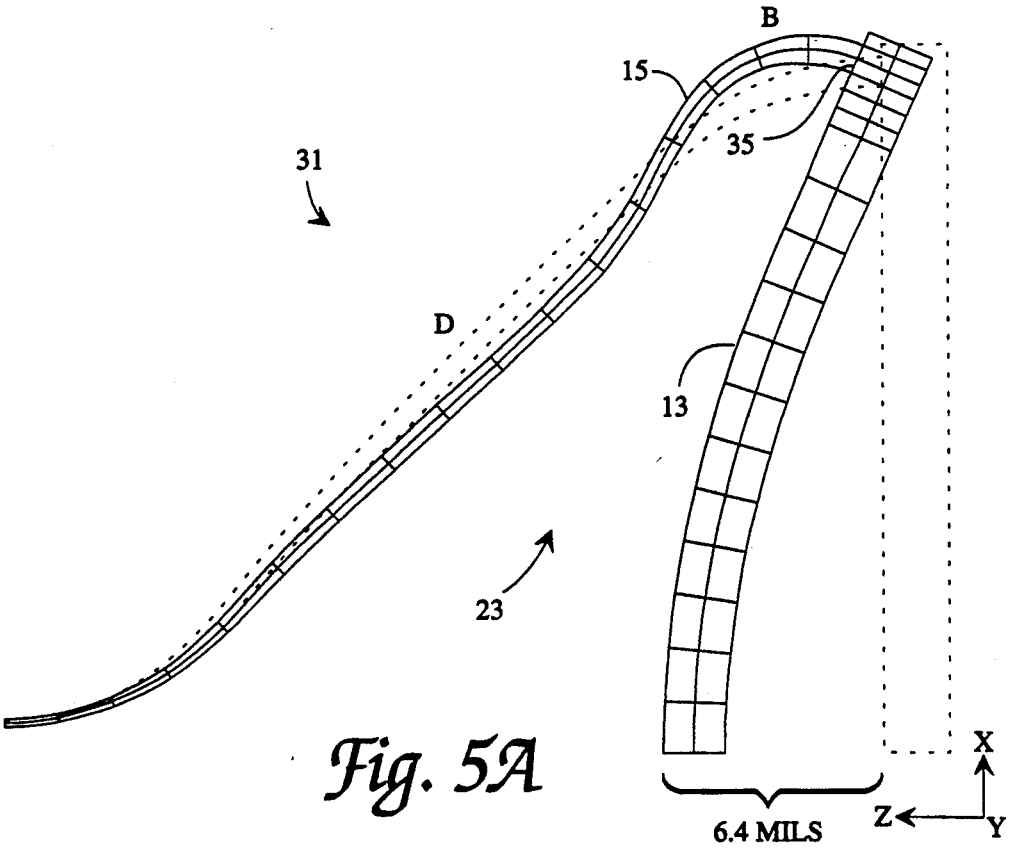

FIG. 2 shows differences in funnel wall shapes between the preferred funnel 23 and the known funnel 25 by illustrating exterior surface sections of the funnel 15 through the major, minor, and diagonal axes. The most obvious difference is that the diagonal section 27 is concave on the preferred funnel 23. The minor section 29 is nearly the same and the major section 31 is brought in closer to the center 33 of the tube. The funnel thickness is kept the same because it is based upon funnel glass supplier manufacturing requirements. The elevation contours, ie., the shape of sections-through the X-Y plane at a certain point on the Z axis, for the known and the preferred funnels are different, as discussed below.

FIGS. 3A through 5B compare the deformed shapes of the known 25 and preferred 23 funnel design loaded by 14.7 psi external pressure. The undeformed shapes are shown in phantom for reference. Only one quarter of the envelope need be shown due to the symmetry thereof. As seen in FIGS. 4B and 4B the panel 13 of the preferred funnel 23 deforms inwardly 6.4 mils, slightly more than the 6.0 mils of the known design as shown in FIGS. 4A and 5A. The preferred funnel 23 bulges outwardly at points A and B, slightly more than in the known funnel 25. As best seen in FIGS. 4A and 4B, the biggest difference between the two designs is the amount of inward bulging at point C. The inward bulging is almost eliminated at point C on the preferred design.

For both envelope designs, the highest stresses are on the funnel 15 at the intersection of the seal land 35 with the panel 13. These stresses, which are due to bending, are caused by rotational discontinuities between funnel 15 and panel 13 at the seal land 35. To understand the nature of these discontinuity stresses, it is helpful to consider the deformation of the funnel 15 and panel 13 separately. This can be done by considering each component with a simple support at the seal land 35 instead of an attachment to the other component. By a simple support, it is meant that the land 35 can rotate, but cannot translate in a direction normal to the support. In the discussion that follows only rotational discontinuities at the seal land will be considered. In reality there are also translational discontinuities, but these are secondary in producing the stresses at the seal land. There is also a constant component to the axial stresses at the seal edge. This component is constant across the thickness, but varies with location along the seal land. This component is compressive and is also of a secondary nature.

Figure 6:
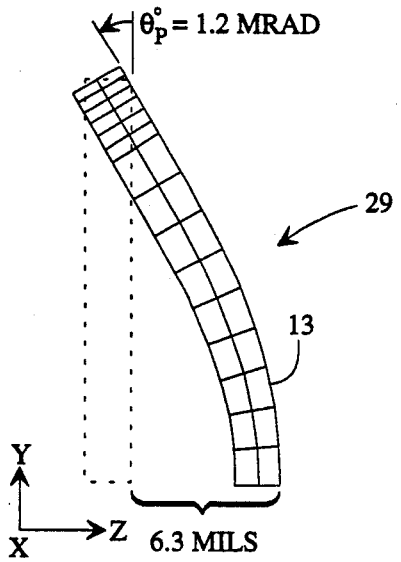
FIG. 6 illustrates deformation of a simply supported front panel on a minor axis section.

If the panel were simply supported at the seal land instead of attached to the funnel, the pressure load would cause the panel edge to rotate through the angle $\Theta_p$, where $\Theta_p$ is a function of the panel thickness. The same panel is used on both envelope designs, so a single analysis covers both cases. This is shown in FIG. 6, which indicates that $\Theta_p = 1.2$ miliradians (mrad) at the minor axis. Since the highest stresses occur on the minor axis, the section 29 through the minor axis funnel walls 24 will be used for all the examples presented.

Figure 7:
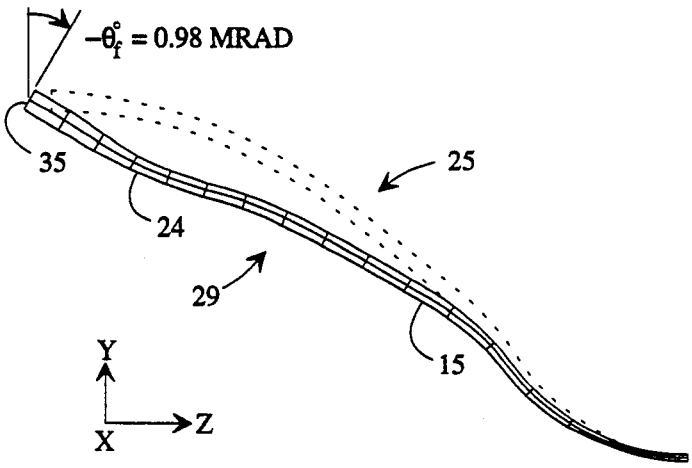
Fig. 7 (PRIOR ART)
FIG. 7 illustrates deformation of a simply supported known funnel on a minor axis section.
Figure 8:
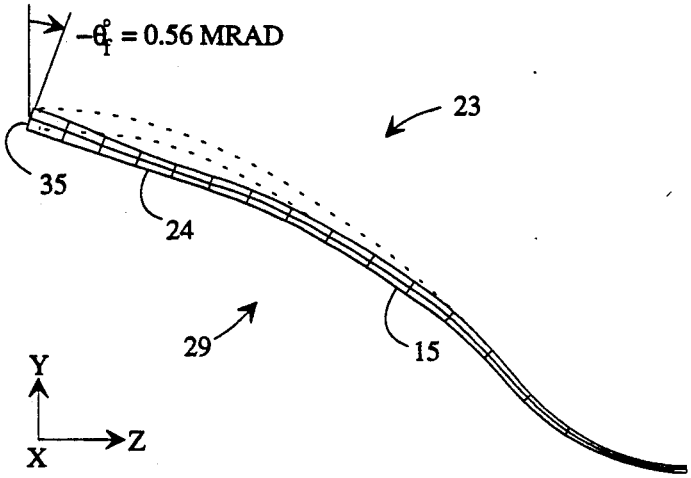
FIG. 8 illustrates deformation of a simply supported preferred funnel on a minor axis section.

FIG. 7 shows the deformation of the funnel wall on the minor axis of the known design with its funnel seal land 35 simply supported. The pressure loads cause the funnel seal land to rotate by $\Theta_f = -0.98$ mrad, where $\Theta_f$ is a complex function of the shape and thickness of the funnel. FIG. 8 shows the deformed shape of the funnel wall minor section of the preferred funnel 23 with its seal land 35 simply supported. For this case, $\Theta_f$ is $-0.56$ mrad. Note that $\Theta_f$ and $\Theta_p$ have signs that indicate the direction of rotation. The arrow in FIG. 6 indicates a positive rotation and the arrows in FIGS. 7 and 8 indicate negative rotations. Undeformed shapes are shown in phantom.

The difference between $\Theta_f$ and $\Theta_p$ is the angle of discontinuity, $\Theta_d$. This is the angle through which internal s must bend the panel and funnel to preserve rotational continuity at the seal land area. For a given value of $\Theta_d$, the magnitude of the bending stresses that are required to enforce continuity is a function of the width of the seal land and the rotational stiffness of the panel and the funnel in the vicinity of the seal land. The ideal situation is $\Theta_d = 0$, which would produce no bending stresses. In practice, this is very hard to accomplish, since $\Theta_p$ is likely to be greater than $\Theta_f$. In fact, as shown in FIGS. 6 through 8, $\Theta_f$ and $\Theta_p$ are likely to have different signs. Consequently, $\Theta_d$ can only be minimized by either decreasing $\Theta_p$ or increasing $\Theta_f$. The only practical way of decreasing $\Theta_p$ is to increase the panel thickness, which has its limitations. There fore, increasing $\Theta_f$, i.e., making it more positive, is the primary way of minimizing $\Theta_d$. The fact that $\Theta_f$ is larger for the preferred envelope explains why the stresses are lower than in the known design. Thus, the preferred envelope yields approximately eleven percent higher strength than the known design.

Figure 9:
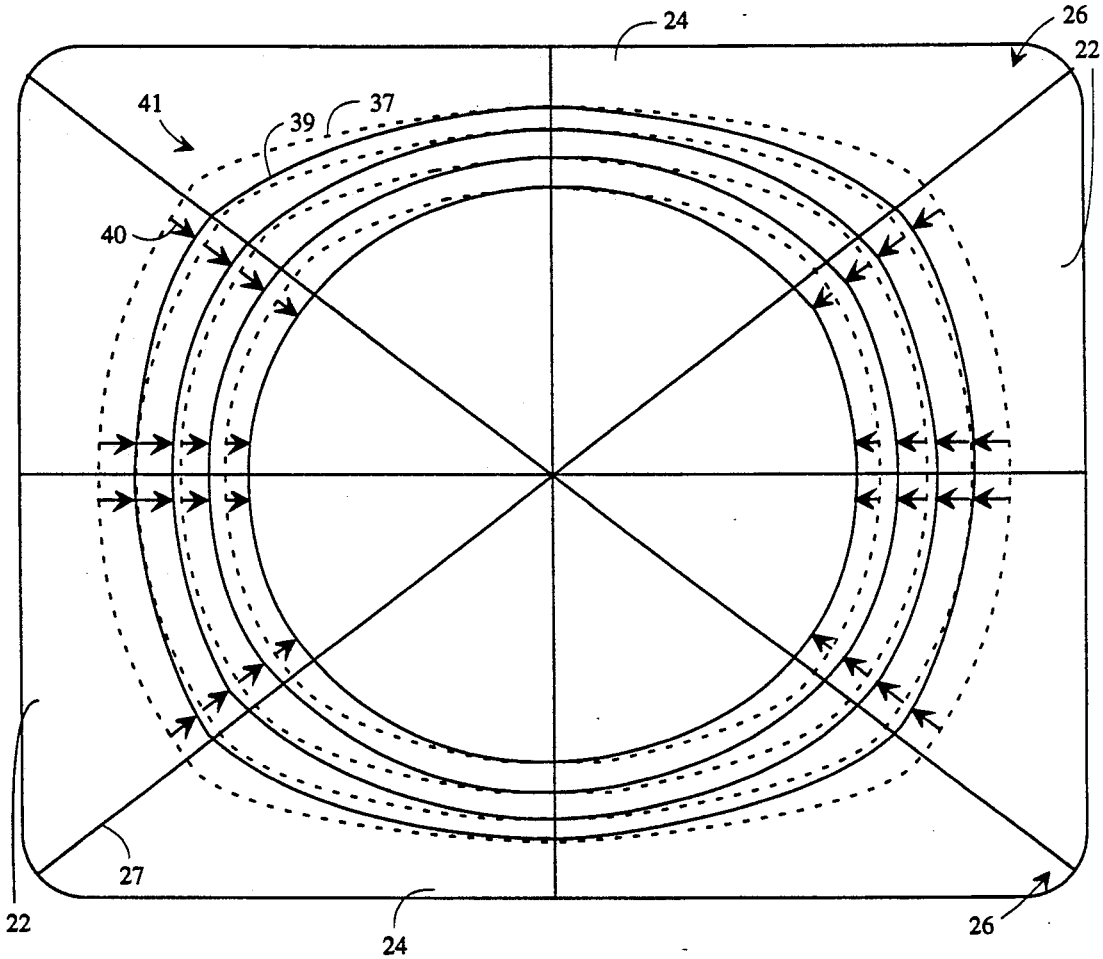
FIG. 9 illustrates known and preferred like-elevation contour sections through the compared funnel designs.

The question that still remains is, how do the geometry changes of the preferred design, as shown in FIG. 2, increase $\Theta_f$ and thereby reduce funnel stresses?. The answer can be seen in FIG. 9, which compares the known and preferred elevation contours 37 and 39 respectively, in the region of the funnel 15 where the sections were changed the most. The arrows 40 show how the contours were modified in going from the known design to the preferred design. The biggest changes are to, a) introduce more curvature into the contours at the minor axis funnel walls 24, b) make the contours 39 less oblong, and, c) make the contours 39 less "rectangular," ie., sharp cornered, by smoothing out the transition into the corner radii 41. All of these are effective in resisting the natural tendency of the funnel wall at the minor axis to bulge inwardly and this in turn increases $\Theta_f$, which reduces the discontinuity stress at the seal land. Moving the contours in at the diagonal walls 26, i.e., actually making the funnel wall at the diagonal axes 27 concave, makes these modifications possible. The amount by which the diagonal walls 26 can be brought in is limited by the need for electron beam clearance inside the envelope. Adding curvature to the contours 39 at the minor axis walls 24 helps support the pressure load with membrane stresses rather than bending stresses, thereby decreasing the bending deformation that causes the minor axis to bulge inward. The term membrane stress refers to the component of the stresses in the direction tangential to the mid-surface that is constant through the funnel thickness. Bending stress refers to the component that varies linearly across the funnel thickness. Making the contours 39 less oblong also helps in this regard, since structures with oblong cross-sections tend to bulge inward at the minor axis when pressured. Lessening the aspect ratio reduces this tendency. Making the contours less rectangular also helps promote membrane, rather than bending, stresses.

Referring again to FIG. 2., the key aspect to the way that the discontinuity stresses were reduced is the concavity that was introduced on the diagonal funnel walls 26. The present invention is not strictly limited to FTM bulbs, but discontinuity stresses are more of a problem for FTMs than conventional CRTs because, 1) the transmission between the funnel and panel is more abrupt, 2) the panel has less curvature, causing it to deflect more, and 3) the point of highest discontinuity stress is at the seal edge, an inherently weakened point.

While the present invention has been illustrated and described in connection with the preferred embodiments, it is not to be limited to the particular structure shown, because many variations thereof will be evident to one skilled in the art and are intended to be encompassed in the present invention as set forth in the following claims:

What is claimed is:

1. A CRT funnel comprising;

a) a first end having a substantially rectangular seal land area for mating with a CRT facepanel, b) a second end having a substantially conical region for mating with a CRT neck, c) a body extending between the first and the second end, the body having an interior and an exterior; and minor, major, and diagonal axes as defined by the rectangular seal land of the first end, with a section through a diagonal axis of the body being substantially concave along the edges thereof, as viewed from the exterior of the funnel.

2. The CRT funnel of claim 1 further characterized in that a section through the major axis is substantially linear along the edges thereof as viewed from the exterior of the funnel.

3. The CRT funnel of claim 2 further characterized in that a section through the minor axis is substantially convex along the edges thereof as viewed from the exterior of the funnel.

4. A CRT envelope comprising;

a) a funnel having;

1) a first end having a substantially rectangular seal land area for mating with a CRT facepanel, 2) a second end having a substantially conical region for mating with a CRT neck, 3) a body extending between the first and the second end;

the body having an interior and an exterior; and minor, major, and diagonal axes, as defined by the rectangular seal land of the first end with a section through a diagonal axis being substantially concave along the edges thereof as viewed from the exterior of the funnel;

b) a substantially flat, rectangular faceplate sealed to the funnel first end seal land area; and c) a substantially cylindrical CRT neck sealed to the funnel second end.

5. The CRT envelope of claim 4 further characterized in that a section through the major axes of the funnel is substantially linear along the edges thereof as viewed from the exterior of the funnel.

6. The CRT funnel of claim 5 further characterized in that a section through the minor axes of the funnel is substantially convex along the edges thereof as viewed from the exterior of the funnel.

7. A CRT funnel comprising, a) a first end having a substantially rectangular seal land area for mating with a CRT facepanel, b) a second end having a substantially conical region for mating with a CRT neck;

c) a body extending between the first and the second end, the body having a interior and an exterior; and minor, major, and diagonal axes as defined by the rectangular seal land of the first end, with a section through a diagonal axis being concave along a substantial length of the edges thereof, as viewed from the exterior of the funnel;

whereby, the funnel, when integrated into a CRT envelope, is constructed and arranged to alleviate deflection of the funnel to the interior of the CRT envelope on a section through the minor axis of the funnel.

8. The CRT funnel of claim 7 further characterized in that a section through the major axis is substantially linear along the edges thereof as viewed from the exterior of the funnel.

9. The CRT funnel of claim 8 further characterized in that a section through the minor axis is substantially convex along the edges thereof as viewed from the exterior of the funnel.

* * * * *